United States Patent [19]

Peterson, Jr.

[11] 4,200,243

[45] Apr. 29, 1980

[54] COMMINUTION DEVICE

[75] Inventor: Russell I. Peterson, Jr., Oil City, Pa.

[73] Assignee: Conair, Inc., Franklin, Pa.

[21] Appl. No.: 854,129

[22] Filed: Nov. 23, 1977

[51] Int. Cl.[2] ..... B02C 18/16

[52] U.S. Cl. ..... 241/224; 241/37.5; 241/285 A

[58] Field of Search ..... 241/36, 37.5, 221–225, 241/285 R, 285 A

[56] References Cited

U.S. PATENT DOCUMENTS

| | | | |
|---|---|---|---|
| 2,554,071 | 5/1951 | Strawn | 241/285 UX |
| 2,994,485 | 8/1961 | Elwick | 241/222 X |
| 3,360,207 | 12/1967 | Shelton, Jr. | 241/285 A |
| 3,419,223 | 12/1968 | Morin | 241/37.5 X |
| 3,897,016 | 7/1975 | Shah | 241/285 A X |
| 3,960,334 | 6/1976 | Wudyka | 241/222 X |
| 4,043,514 | 8/1977 | Peterson, Jr. | 241/37.5 X |

*Primary Examiner*—Howard N. Goldberg

[57] ABSTRACT

A comminution device having an improved means for displacing the loading hopper to obtain access to the interior of the comminution device from the upper end thereof as well as an improved means for controlling actuation of the comminution assembly and an improved arrangement for material discharge therefrom.

4 Claims, 4 Drawing Figures

COMMINUTION DEVICE

CROSS REFERENCE TO RELATED APPLICATION

U.S. patent application Ser. No. 848.939, Filed Nov. 7, 1977, entitled "Comminution Device" and assigned to the same assignee as is this invention.

Comminution devices are used in various industries with one particularly one well known prior use being in the plastics industry in which such devices are commonly referred to as plastic granulators. Plastics granulators are often used to fragmatize pieces or sections of plastic material which constitutes scrap or waste from various plastic forming operations so that the fragmatized pieces may be reused in subsequent plastic forming operations. One common type of plastics granulator is provided with a plurality of bed knives positioned about the cutting circle of a multi-bladed rotary cutting member with the plastic material being cut or fragmatized by the well known cooperative action of the rotating knives and the bed knives. Such prior granulators may be of various well known forms such as shown in U.S. Pat. Nos. 2,830,770; 3,419,223; 3,756,519; 3,790,093; 2,381,775; 3,643,880; as well as the above mentioned U.S. patent application Ser. No. 848,939.

Plastic pieces are generally fed to such plastic granulators through a loading hopper located ajdacent to the upper end thereof. Such plastic pieces are of a wide variety of size, thickness and shape so that during their fragmatation the amount and orientation of such material with respect to the rotating and bed knives varies substantially which has resulted in frequent stalling of prior plastic granulators or required a large horse power drive. Since the rotating member of the comminution structure can become stuck during operation it is necessary to provide reasonably easy access to the comminution structure to permit removal of the plastic pieces which are inhibiting or preventing the rotor member from rotating. Also in many instances it is desirable to obtain access to the plastic granulators from the upper end thereof to clean the interior surface such as when fragmatizing a material of a different color or to permit the replacement or sharpening of the removable rotating knives.

With existing plastic granulators, access thereto from the upper end thereof is generally obtained by physically removing the loading hopper or by pivoting the loading hopper about an edge hinge to an open position. In view of the size and weight of the loading hopper, removal or pivoting by a single individual was often impractical, impossible or required additional equipment. When pivoted about a hinge to an open position the center of gravity of the granulator is effected and in some instances is displaced to a position whereat the structure was unstable thereby necessitating a larger framework of some sort of permanent foundation. Furthermore, when closing a hinged hopper the size and weight may result in a serious safety hazard if it were to inadvertently swing closed in an uncontrollable manner. A power assist for hinge opening and closing, such as by piston actuation, would add considerably to equipment cost and maintenance and the granulator may still be unstable when the hopper was in the open position. Still further, in the event of either a removal or pivotable loading hopper, the overall space requirement for the plastics granulator is increased substantially because of the need for space to either lift the loading hopper or to pivot the loading hopper through an arc having a radius equal to the chord length of the hopper.

The present invention includes a loading hopper which is rendered selectively slidable along a guide channel to provide a quick and safe access to the interior of the plastics granulator from the upper portion thereof.

Accordingly, a primary object of this invention is to provide a new and improved means for displacing the inlet hopper to obtain access to the interior of a plastics granulator from the portion thereof upwardly above the rotatable knife structure.

Another object of this invention is to provide a new and improved plastics granulator employing a sliding loading hopper which requires operation of an interlock for controlling the braking and actuation of a drive fly wheel.

Still another object of this invention is to provide an improved discharge means for fragmatized plastic material from a plastics granulator.

These and other objects are advantages of the present invention will become more readily apparent upon consideration of the following detailed description and drawings of the presently preferred embodiment thereof in which.

Figure 4:
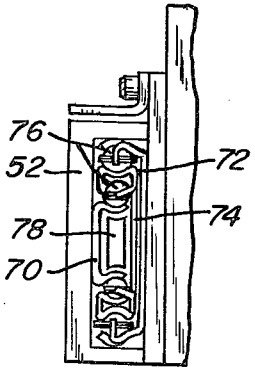
FIG. 4 is an enlarged and elevational view of a slide mechanism as shown in FIG. 3.

One known form of a plastics granulator comprises a formed support or housing 10 having a vertically extending portion 12 at one side thereof which portion 12 encloses a suitable fly wheel 13 which is connected to drive rotable portions of a comminution assembly 11. Housing 10 additionally includes another vertically exending portion 15, at the side thereof opposite portion 12, which encloses a suitable drive mechanism for driving the rotable portions of a discharge conveying means, such as screw conveyer 28. Housing 10 has a fabricated base portion 20 for supporting the comminution assembly 11, the screw conveyor 28, a material loading hopper 26 located upwardly adjacent assembly 11, a material discharge hopper assembly 22 located downwardly adjacent assembly 11 and a motor 24 for selectively driving the fly wheel 13 and the screw conveyor 28.

The comminution assembly 11 consists of a formed stationary bed member 16, carrying stationary bed knives (not shown), and a rotor member 18 carrying rotating knives 21. Rotor member 18 is rotably driven by a central elongated shaft 19 which is supported for rotation by the bed member 16 in any suitable manner and is suitably rotatably driven by the fly wheel 13. Fly wheel 13 is driven in any known manner, for example by a plurality of drive belts 17 orbiting between the fly wheel 13 and motor 24. For the purposes of this invention the comminution assembly 11 and the drive for fly wheel 13 may be of any suitable arrangement; however, the preferred form of the comminution assembly 11 and the drive therefore are respectively more particularly shown and described in U.S. Patent Application Ser. No. 799,457 now abandoned filed May 23, 1977 and in U.S. Pat. No. 4,043,514. Such application and patent are both assigned to the assignee as is this invention and the disclosures thereof are incorporated herein for the purpose of this application.

Figure 2:
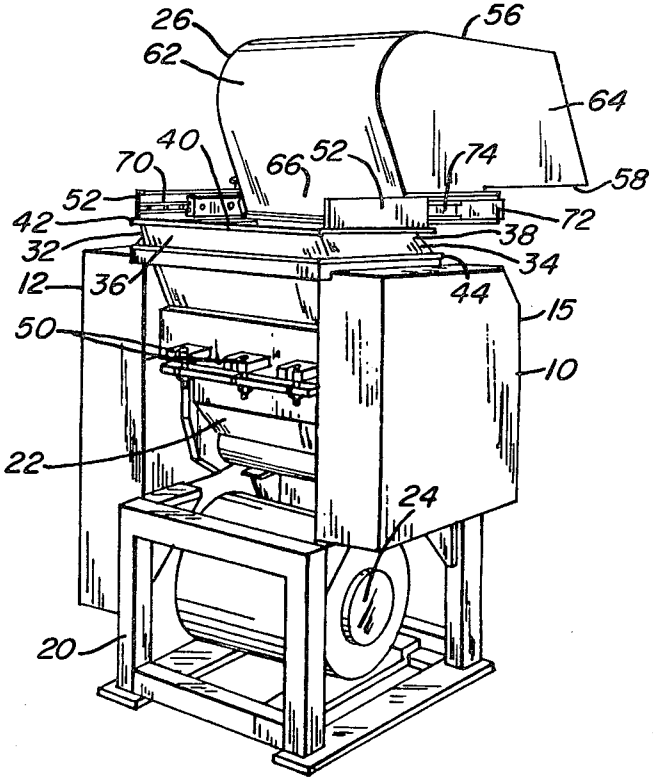
FIG. 2 is a prospective view of the device of FIG. 1 viewed from the opposite side from the view of FIG. 1 with the loading hopper thereof being in the forward or open position and with the sides of the discharge hopper being in the closed position.
Figure 1:
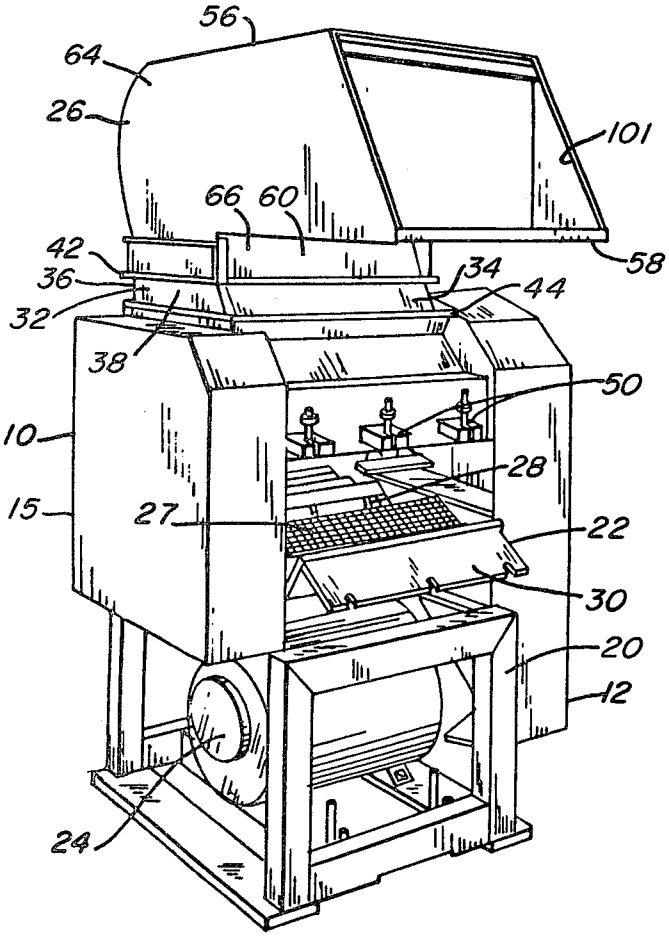
FIG. 1 is a prospective view of a comminution device constructed in accordance with principles of the present invention with the loading hopper thereof being in the closed position and with the discharge hopper being in the open position.

The material discharge hopper 22 is formed and supported by housing 10 in any suitable manner; however, the preferred structure and supporting arrangement for hopper 22 is more particularly shown and described in the co-pending U.S. patent application Ser. No. 848,939, filed Nov. 7, 1977, and assigned to the same assignee as is this invention and the disclosure thereof is incorporated herein for the purpose of the disclosure of this invention. This form of hopper 22 includes a pair of independent hopper sections 30 which are selectively pivotal about a common axis to a closed position for receiving particles fragmatized by the comminution assembly 11 therewith and to an open position for readily gaining access to for interior of the hopper 22 and a sizing screen assembly 27. For further illustration, FIG. 1 shows the hopper 22 in the open position thereof and FIG. 2 shows the hopper 22 in the closed operational position thereof. A suitable means, such as fastening means 50, are provided to releasably retain hopper sections 20 in the closed position. The accumulated fragmatized particules within discharge hopper 22 are conveyed therefrom by a continuous flight 29 of screw conveyor 28 through an opening (not shown) adjacent the vertically extending portion 15. A suitable bin (not shown) may be positioned adjacent the lower open end of portion 15 for receiving the fragmatized material which is conveyed from hopper 22 by screw conveyor 28.

The loading hopper 26 is slidably mounted on housing 10 to be selectively movable to an open and closed position with the open position allowing access to the interior of housing 10 from the upper end thereof and with the closed position of hopper 26 being the operational position for loading plastic to be fragmatized to the plastics granulator. To aid in the following description of hopper 26, the sliding arrangement therefor and for other aspects of this invention, forward and rearward shall refer, respectively, to towards and away from the open position of loading hopper 26.

Figure 3:
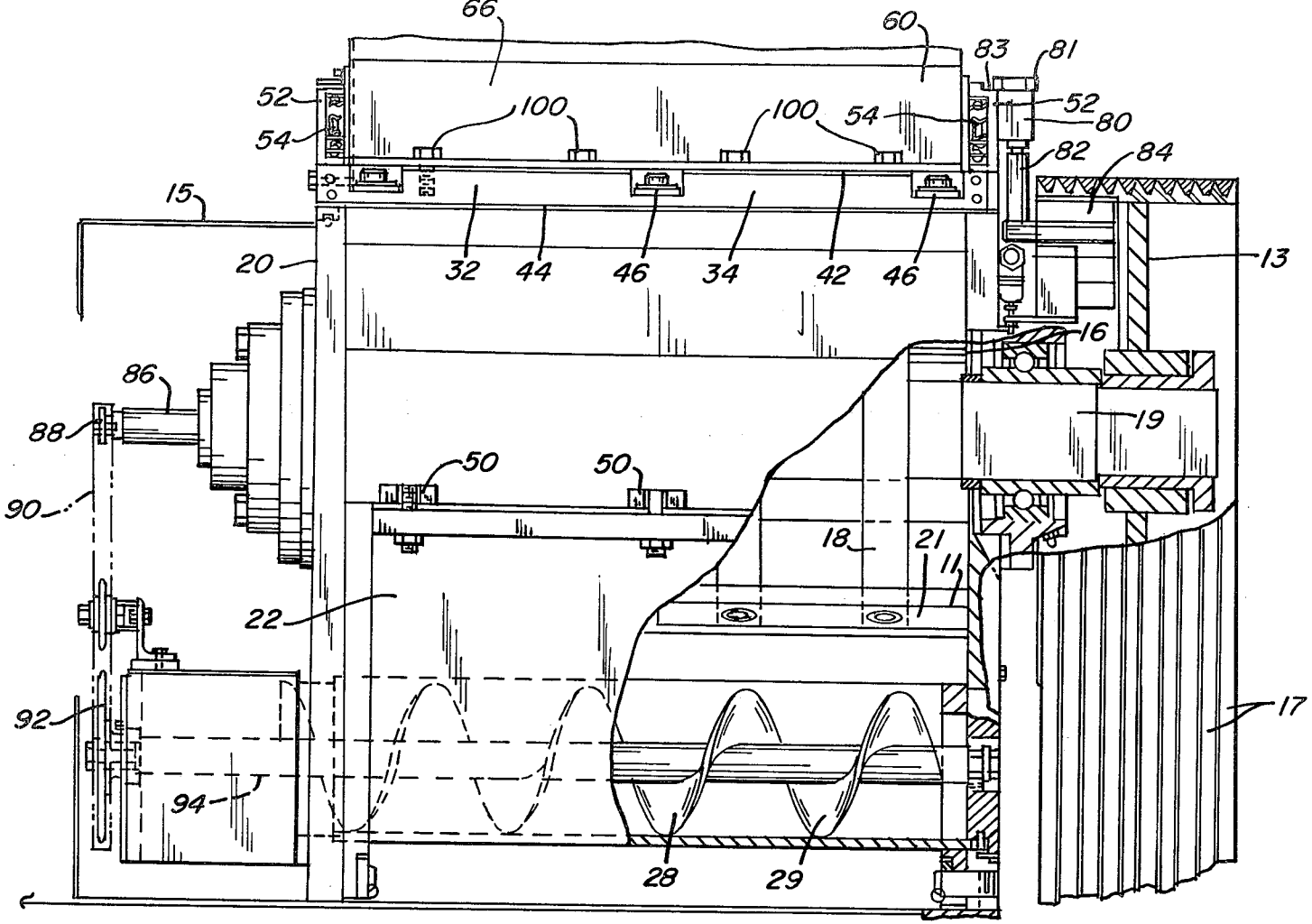
FIG. 3 is an enlarged side elevational view, partly in section, of a lower portion of the comminution device as shown in FIG. 2.

Loading hopper 26 is slidably mounted with respect to housing 10 by means of a support frame 32 which is disposed vertically intermediate housing 10 and a lower end portion of hopper 26. The support frame 32 is of a generally square configuration and comprises elongated forward and rear walls 34 and 36, respectively, and sidewalls 38 which extend between walls 34 and 36 adjacent respective axial ends thereof. Walls 34 and 36 are spaced in the direction of movement hopper assembly 26 and extend transversly with respect to such direction of movement. The inner peripherial surfaces of walls 34, 36 and 38 define a vertically extending opening 40 through support frame 32. With hopper assembly 26 being in the closed position, as illustrated in FIGS. 1 and 3, plastic material which is to be fragmatized drops through opening 40 from hopper 26 with hopper 26 being in the open position, as illustrated in FIG. 2, access to the interior housing 10 is obtained through opening 40. It is noted that walls 34 and 36 are sloped slightly forwardly from the upper ends thereof to aid in the proper orientation of the flow of material to be granulated to the comminution assembly 11.

Support frame 32 additionally includes upper and lower peripherial flanges 42 and 44, respectively, which extend continuously around walls 34, 36 and 38 adjacent the respective vertical ends thereof and extend outwardly therefrom away from opening 40. The lower flange 44 is suitably secured to housing 10; for example, by vertically extending bolts 46, to maintain the frame 32 fixed with respect to housing 10. Inwardly toed support channels 52 have the lower ends thereof secured to upper flange 42 and extend continuously therealong upwardly adjacent each side wall 38. The channels 52 have a generally "U" shaped configuration formed from a pair of vertically spaced flanges which extend inwardly from a vertically extending web. Each channel 52 carries a cooperating portion of a respective slide mechanism 54 which mechanisms 54 permit sliding open and closing motion of the loading hopper 26.

The loading hopper 26 is formed of plate work and comprises: vertically spaced top and bottom walls 56 and 58, respectively; forward and rear end walls 60 and 62, respectively; and elongated transversally spaced side walls 64 which continuously extend between adjacent edges of walls 56, 58, 60 and 62. Bottom wall 58 has the rear end thereof intermediate the forward and rear ends of side walls 64 and extends forwardly therefrom. The forward end wall 60 has the upper end thereof adjacent the rear end of bottom wall 58 and extends downwardly therefrom. The portion of side walls 64 rearwardly of end wall 60 extend downwardly to lie in a plane common with the lower end of wall 60 and these portions, in conjunction with a similar downwardly extending portion of rear end wall 62 and also in conjunction with forward end wall 60, form the boundaries of a lower vertically extending throat portion 66 of loading hopper 26. Throat portion 66 is of a generally square configuration and the inner peripherary thereof is substantially equal in dimensions and orientation to opening 40 of support frame 32. Such configuration of loading hopper 26 permits material to be introduced or fed through the horizontally open forward end 101 of hopper 26 to travel from such forward end 101 along the length of hopper 26 to throat portion 66 so that the material will drop through throat portion 66 and through the opening 40 to the comminution assembly 11. In the closed position of hopper 26, the throat portion 66 will bear directly on support frame 32 and the portion of hopper 26 which extends forwardly from portion 66 will be the only portion of hopper 26 which is not directly supported by the slide mechanisms 54. Slide mechanisms 54 provides a means for supporting such forwardly extending portion of hopper 26. The horizontally extending portion of hopper assembly 26 forwardly of throat portion 66 in conjunction with the 90 degree turn to the throat portion 66 is highly desirable for the dual purpose of preventing the operator from reaching into the plastics granulator and perhaps being injured as well as to prevent the operator from introducing plastic materials into the granulator which are of a size larger than the size for which the comminution assembly 11 was designed to pulverize properly. Suitable releasable securing means such as bolts 100 are provided adjacent the forward and rear ends of throat portion 66 to releasably retain loading hopper 26 in the closed position thereof.

The operation and configuration of the slide mechanisms 54 are structured quite similarly to known type slide arrangements for heavy duty file drawers. More particularly, and as best illustrated in FIG. 4, each slide mechanism 54 includes a plurality of parallel longitudally extending cooperating channel shaped members which comprise: an outer inwardly toed stationary slide channel 70 which is rigidly carried by support channel 52 and extends continuously along the inner surface thereof; an inner outwardly toed stationary slide channel 72 which is rigidly carried by input portion 66 and extends continuously along the side surface thereof which is defined by the downwardly extending portion of a respective side wall 64; and an intermediate outwardly toed movable slide channel 74. The channels 70, 72 and 74 each have a generally "U" shaped configuration formed of vertically spaced flanges which extend horizontally from respective vertically extending webs. The internally facing surfaces of the flanges of each slide channel 74 are movably supported by the respective externally facing surfaces of the flanges of the adjacent stationary slide channel 70. Furthermore, the externally facing surfaces of the flanges of each movably slide channel 74 are movably supported by the respective internally facing surfaces of the flanges of the adjacent stationary slide channel 72. Suitable bearing means, such as ball bearings 76 are positioned intermediate flange surfaces of the movable slide channel 74 and the adjacent flange surfaces of stationary slide channels 70 and 72. Ball bearings 76 are suitably captively received intermediate respective flanges of the channels 70, 72 and 74 in a manner that such flanges form the necessary race and raceways for the sliding movement of the loading hopper 26.

When sliding loading hopper 26 to the open position thereof to obtain access to housing 10 from the upper end thereof, the bolts 100 are initially released and thereafter the hopper 26 is pulled or pushed forwardly. During the initial portion of the forward movement of hopper 26, channel 72 and 74 both move forwardly with respect to channel 70. When hopper 26 has moved approximately one half of the distance across opening 40, a rear end portion of movable slide channel 74 will engage an appropriate internal stop (not shown) carried by channel 70 intermediate the axial ends thereof, and channel 74 will be prevented from further forward movement. However, channel 72, which is secured to hopper 26, will continue moving forwardly and during such movement will be suitably guided and supported by channels 70 and 74. The forward movement of hopper 26 and channel 72 will continue until a rear end portion of channel 72 engages an internal stop (not shown) carried by channel 52. When such engagement occurs, hopper 26 will be prevented from further forward movement and will be in the open position thereof thereby permitting full access to opening 40. Such a sliding movement, coupled with the internal stops and channel supporting arrangements, provides that even when hopper 26 is in the full open position thereof the overturning moment of hopper 26 is reduced substantially because of the support of tieback offered by channel 74 at the midpoint of opening 40 since the eccentric loading of open hopper 26 is resisted at the midpoint of opening 40 rather than the forward end thereof, which would be the case if channel 74 moved with channel 72 across the entire length of opening 40.

The above described supporting arrangement provides a smooth and guided motion of the loading hopper 26 during movement to the open and closed positions. Such guiding motion is further assisted by a longitudinally extending guide bar 78 which is regidly carried by the movable slide channel 74 and extends continuously along the outer surface of the vertically extending web thereof. The upper and lower longitudinally extending surfaces of each guide bar 78 are positioned closely adjacent respective internally facing surfaces of the flanges of stationary slide channel 70 thus providing a more controlled slide and guide arrangement for slide mechanisms 54.

An additional feature of the invention herein resides in the location and usage of a safety switch means 80 which must be rendered operative, to brake the fly wheel 13, in order to iniate sliding of loading hopper 26 to the open position thereof. Switch means 80 is located adjacent the forward end of support frame 32 and is supported therefrom. When hopper 26 is in the closed position thereof, a vertically movable plunger portion 82 of means 80 is moved downwardly until plunger 82 engages a suitable switch (not shown) to interrupt a circuit which normally causes a brake shoe 84 to engage the inner peripherary of fly wheel 13. The downward movement of plunger portion 82 is accomplished by torquing of a bolt 81 having the lower end thereof in engagement with the upper end of plunger portion 82. The forward end of support channel 52 adjacent switch means 80 includes an upwardly open groove 83 therein and when bolt 81 is torgued downwardly a portion of the head thereof is seated within groove 83. The downward movement of plunger portion applies a compressive force to an adjacent portion of input portion 66. Accordingly, in order to slide the hopper 26 to the open position thereof, plunger 82 must be permitted to move upwardly by the upward torquing of bolt 81, in addition to the release of bolts 100. It is noted that in the closed position of hopper 26, plunger portion 82 must be moved downwardly to release the brake shoe 84 and thus render the plastics granulator operative. The safety switch means 80, the brake shoe 84 and also the circuitry and supporting hardware for means 80 and shoe 84 may be of any suitable arrangement; however, the preferred forms thereof are more particularly shown and illustrated in U.S. Pat. No. 4,043,514, which is assigned to the same assignee as is this invention, and the disclosure of such patent is incorporated herein for the purpose of this description.

The drive for screw conveyor 28 is best illustrated in FIG. 3 wherein an extention portion 86 of comminution assembly drive shaft 19 extends into vertical portion 15 and has a sprocket 88 secured thereto adjacent the free end thereof. A timing chain 90 orbits between sprocket 88 and a sprocket 92 which is secured to the free end of a drive shaft 94 of screw conveyor 28. Thus, when motor 24 is energized and brake shoe 84 is disengaged, the fly wheel 13 drives the shaft 19 which in turn drives the shaft 94 of conveyor 28. When safety switch means 80 is in up position thereof, the brake shoe will engage fly wheel 13 and, in addition to halting the rotation of shaft 19, will result in the cessation of rotation of shaft 94.

The embodiment described herein is the presently preferred embodiment of a comminution device constructed in accordance with the principals of the invention; however, it is understood that various modifications may be made to the embodiment described herein by those knowledgeable in the art without departing from the scopt of the invention as defined by the claim set forth hereinafter. For example: the invention herein is equally applicable to comminution devices other than the application to a plastics granulator as is described herein; safety switch 80 may be also be adapted to control the energization and de-energization of the motor 24, alternative configurations may be utilized for the slide mechanisms 54; and the like.

What is claimed is:

1. A comminution device comprising: a generally vertically extending housing member having an upwardly open material receiving opening formed therewithin; comminution means supported within said housing member below said opening and operable to effect size reduction of material fed thereto through said opening; a loading hopper member having a vertically extending throat portion with a lower end, cooperable slide means having relatively movable portions carried by said lower end and a portion of said housing member adjacent said opening, respectively, to continuously captively support said hopper member with respect to said housing member while permitting relative movement between said hopper member and said housing member, and said movable portions of said cooperable means being movable through an extent to selectively locate said throat portion in a closed position in vertical alignment with said opening and an open position offset from said housing member to provide access to said comminution means through said opening.

2. A comminution device as specified in claim 1 wherein said hopper member is offset from said housing member in the open position a distance that the entire periphery of said opening is uncovered.

3. A comminution device as specified in claim 1 wherein said relatively movable portions are elongated and provide a cantilever support for said hopper member when said hopper member is in the open position.

4. A comminution device as specified in claim 3 wherein said elongated movable portions are in overlying relationship with respect to each other when said hopper member is in the closed position.

* * * * *